United States Patent [19]

Detalle

[11] 4,194,706

[45] Mar. 25, 1980

[54] DEVICE FOR IMPARTING A MOVEMENT OF ROTATION TO A CRAFT WHEN IT IS LAUNCHED

[75] Inventor: Bernard Detalle, L'Hay-les-Roses, France

[73] Assignee: Societe Europeene de Propulsion, Puteaux, France

[21] Appl. No.: 896,010

[22] Filed: Apr. 13, 1978

[30] Foreign Application Priority Data

Apr. 21, 1977 [FR] France ..... 77 12070

[51] Int. Cl.[2] ..... F42B 13/22

[52] U.S. Cl. ..... 244/3.23; 244/3.25

[58] Field of Search ..... 244/3.23, 3.24, 3.25, 244/3.27, 3.28, 3.29, 3.3; 102/93

[56] References Cited

U.S. PATENT DOCUMENTS

| | | | |
|---|---|---|---|
| 308,944 | 12/1884 | Bartlett | 244/3.3 |
| 1,141,042 | 5/1915 | Davis | 244/3.3 |
| 3,053,184 | 9/1962 | Francois | 244/3.28 |
| 3,430,900 | 3/1969 | Turneret al. | 244/3.25 |
| 3,862,603 | 1/1975 | Kornblith | 102/93 |

*Primary Examiner*—Verlin R. Pendegrass

*Attorney, Agent, or Firm*—Eyre, Mann, Lucas & Just

[57] ABSTRACT

The present invention relates to a device for imparting a movement of rotation to a craft with nozzle propulsion system during launching thereof by means of a launching member, said device comprising: a wheel with vanes or fins formed by a section of tube located in the rear extension of the nozzle, the tube section having an outer surface at least partly in permanent contact with the launching member during its path inside said latter, and bearing, on the inside, vanes or fins constituting surfaces deflecting the jet produced by the nozzle, the wheel being divided into distinct annular sectors juxtaposed to form said tube section, each sector extending over an angle at the most equal to 180°, and bearing at least one vane or fin; and connecting means comprising at least one locking element associated with each annular sector to render this latter fast with the nozzle in the direction of rotation about the axis of the nozzle and parallel to this axis, said connection means cooperating with the launching member to maintain, upon launching, the wheel in fixed position with respect to the nozzle, and to allow the separation of said device and the craft, on leaving the launching member.

5 Claims, 3 Drawing Figures

DEVICE FOR IMPARTING A MOVEMENT OF ROTATION TO A CRAFT WHEN IT IS LAUNCHED

The present invention relates to a device for imparting a movement of rotation to a craft when it is launched.

It is well known, for reasons of precision of trajectory, to rotate a craft in its launching tube or ramp to impart thereto, when leaving said tube or ramp, a speed of rotation which is generally not high, of the order of 5 to 10 revs per second.

A well known solution is to form grooves in the launching tube. However, such grooves are very difficult and expensive to produce, particularly at mass production stage. Furthermore, the mass of the tube is high due to the thickness which must be provided for its wall.

To remedy these drawbacks, it is known to impart a movement of rotation to the craft by means of fins deflecting the jet of gas produced by the nozzle. A first known solution consists in placing the fins in the nozzle of the propulsion system of the craft. A major defect of this solution is that the craft is subjected to an acceleration in rotation during the whole period of functioning of the propulsion system, this generally having for its consequence to produce a final speed of rotation which is too high to be compatible with a good aerodynamic behaviour of the craft. Moreover, this results in a loss of useful power accompanied by a risk of asymmetry of the jet which may cause an angular divergence of thrust able to annul the effects of the rotation from the point of view of precision of trajectory.

U.S. Pat. No. 3,430,900 has also proposed to dispose the fins individually in grooves formed in the nozzle so that the fins may be ejected upon launching.

Now, the presence on the nozzle of grooves, open after the fins have been ejected, can but seriously affect the precision of the trajectory of the craft in flight and introduce divergences which do more than annul the beneficial effect of the initial rotation. Moreover, the number of pieces ejected upon launching may in this case be high since it is equal to the number of fins.

It has further been proposed to use a device of the type comprising a wheel with vanes or fins formed by a section of tube located in the rear extension of the nozzle, the section of tube having an outer surface at least partly in permanent contact with the launching member during its path inside same, and connection means which cooperate with the launching member to maintain, during launching, the wheel in fixed position with respect to the nozzle and to allow the separation of said device and the craft, on leaving the launching member. A device of this type is described in U.S. Pat. No. 3,547,031. However, this known device comprises a complete wheel with vanes or fins, connecting elements connecting this wheel to the nozzle in the axial direction, and lugs borne by the wheel to cause said wheel to rotate with the nozzle. During the ejection of the wheel, said latter necessarily passes through the jet of gas produced by the nozzle, hence a disturbance in the trajectory of the craft. In addition, the separation of the wheel is accompanied by the ejection of a relatively large number of pieces, this not being without serious consequences for the environment and the trajectory of the craft.

It is an object of the present invention to provide a device of the above-mentioned type, in which the pieces ejected upon launching are reduced in number and do not disturb the trajectory of the craft.

This object is attained according to the invention by the fact that the wheel is divided into distinct annular sectors juxtaposed to form said tube section, each sector extending over an angle at the most equal to 180° and bearing at least one vane or fin, and the connection means comprise at least one locking element associated with each annular sector to render this latter fast with the nozzle in the direction of rotation about the axis of the nozzle and parallel to said axis.

According to a feature of the device according to the invention, the locking element associated with each annular sector is fast therewith, and is for example an element of the pin type housed in a recess in the outer wall of the nozzle.

Each sector preferably presents an inwardly folded edge engaged in an annular groove formed on the periphery of the rear part of the nozzle.

The invention will be more readily understood on reading the following description with reference to the accompanying drawings, in which.

Figure 3:
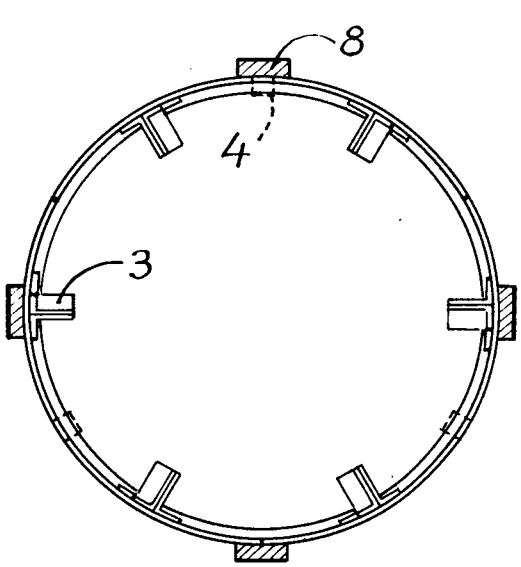
FIG. 3 is a view similar to FIG. 2 of the device shown in FIG. 1, mounted on a craft placed in a launching ramp.

Referring now to the drawings, reference 1 denotes the nozzle of the propulsion system of a craft. The craft and the propulsion system may be of any known type, for example provided with fins which are folded on the body of the propulsion system before leaving the launching tube or ramp.

To the rear of the nozzle is mounted a wheel 2 with vanes or fins. This wheel 2 is in the form of a tubular, thin-walled section which is connected to the rear end 1*a* of the nozzle 1, on the outer peripheral surface of this end. A part 2*a* of the wheel 2 is fitted on the end 1*a* of the nozzle, the rear part 2*b* of the wheel 2 bearing fins 3. The wheel 2 is constituted by a plurality of distinct, juxtaposed sectors. These sectors are three in number, 21, 22, 23 in the example illustrated and are identical. Each sector bears, on its inner face, at least one fin 3. In the example illustrated, each sector bears two fins 3, the wheel comprising six fins regularly distributed angularly.

Each sector 21, 22, 23 is connected to the nozzle 1 by means of a pin 4 which locks this sector to the nozzle in the direction parallel to the axis of the nozzle whilst allowing a relative movement of this sector with respect to the nozzle in at least one direction perpendicular to the axis of the nozzle, preferably in a radial direction. In the example illustrated, each pin 4 is located at the centre of the wheel sector which it connects to the nozzle and is fast with this sector. This pin 4 is in the form of a part or sector of disc, of axis perpendicular to the axis of the nozzle, this disc sector being housed in a recess of corresponding shape, formed in the outer wall of the end 1*a* of the nozzle 1.

Each sector 21, 22, 23 may present an inwardly folded edge 5 at its end resting on the nozzle 1, said edge engaged in an annular groove 6 formed on the periphery of the nozzle.

The fins 3 are constituted for example by plates welded on the inner faces of the sectors 21, 22, 23. In the example illustrated, each fin is constituted by two L-shaped elements 3*a*, 3*b*, back-to-back.

These fins 3 are so oriented as to be struck by the jet emitted by the nozzle 1 during launching of the craft and thus to impart an acceleration to the craft in roll.

Figure 2:
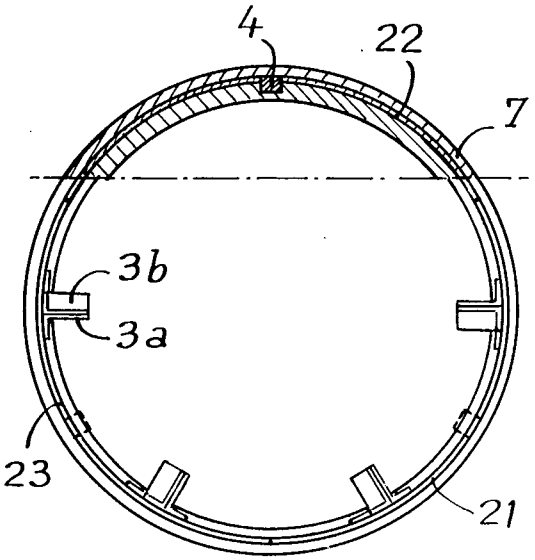
FIG. 2 is a view, partly in radial section along line II—II of FIG. 1, of the device shown in FIG. 1 mounted on a craft placed in a launching tube.
Figure 1:
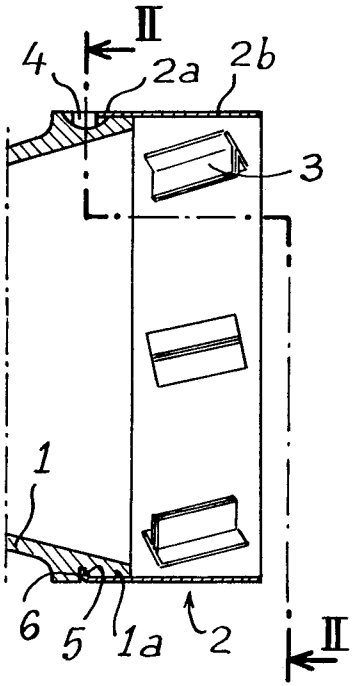
FIG. 1 is a view in longitudinal axial section through a device according to the invention mounted on a craft.

As may be seen in FIG. 2, the three sectors 21, 22, 23 are held in position on the rear end of the nozzle 1 by means of the launching tube 7, the inner surface of this latter being simultaneously in contact with the outer surfaces of the sectors 21, 22, 23 of the wheel 2. The launching tube therefore maintains the sectors 21, 22, 23 locked against the nozzle, preventing any relative radial movement of each sector with respect to the nozzle.

As soon as the functioning of the propulsion system is initiated, the jet deflecting action of the fins provokes the rotation of the craft in the tube. As soon as the sectors 21, 22, 23 of the wheel leave the launching tube, they separate from the nozzle under the effect of the centrifugal force, nothing retaining the pins 4 in their housings.

It will be noted that a particular advantage of the device according to the invention resides in the fact that the speed of rotation of the craft on leaving the launching tube may be precisely determined and possibly easily modified by changing the characteristics of the fins: angle of incidence, surface, number, ...

The device according to the invention may be used with a launching system other than a launching tube, for example with a launching system with open ramp (FIG. 3).

The launching ramp is constituted by guide rails 8 parallel to one another and disposed along rectilinear generatrices of a cylindrical surface. The number and arrangement of these guide rails are chosen so that each wheel sector 21, 22, 23 has its outer surface in contact with the inner face of at least one guide rail 8 when the craft makes a complete revolution inside the launching ramp. In the example illustrated, the rails 8 are four in number and the spaces between adjacent rails are all equal.

In the case of an open ramp, the device according to the invention makes it possible, with respect to the known rotating systems, to avoid providing blocks or lugs placed on the craft and engaging in the rails and, in particular, to avoid having to constitute spiral ramps, each rail being helical, this presenting serious difficulties in manufacture and being of high cost.

What is claimed is:

1. A device for imparting a movement of rotation to a craft with nozzle propulsion system during launching thereof by means of a launching member, said device comprising: a wheel with vanes or fins formed by a section of tube located in the rear extension of the nozzle, the tube section having an outer surface at least partly in permanent contact with the launching member during its path inside said latter, and bearing, on the inside, vanes or fins constituting surfaces deflecting the jet produced by the nozzle, the wheel being divided into distinct annular sectors juxtaposed to form said tube section, each sector extending over an angle at the most equal to 180°, and bearing at least one vane or fin; and connecting means comprising at least one locking element associated with each annular sector to render this latter fast with the nozzle in the direction of rotation about the axis of the nozzle and parallel to this axis, said connection means cooperating with the launching member to maintain, upon launching, the wheel in fixed position with respect to the nozzle, and to allow the separation of said device and the craft, on leaving the launching member.

2. The device of claim 1, wherein the locking element associated with each annular sector is fast with said latter.

3. The device of claim 1, wherein the locking element associated with each annular sector is an element of the pin type housed in a recess in the outer wall of the nozzle.

4. The device of claim 1, wherein each sector presents an inwardly folded edge engaged in an annular groove formed on the periphery of the rear part of the nozzle.

5. Use of the device of claim 1, for the launching of a craft with nozzle propulsion system, by means of a launching ramp constituted by guide rails parallel to one another, disposed along rectilinear generatrices of a cylindrical surface.

* * * * *